US008176582B2

(12) United States Patent
Beard et al.

(10) Patent No.: US 8,176,582 B2
(45) Date of Patent: May 15, 2012

(54) MATTRESS RETAINER BUCKLE

(75) Inventors: Allyn Beard, Gymea Bay (AU); Paul Longman, Pyrmont (AU)

(73) Assignee: A.H. Beard Pty. Ltd., New South Wales (AU)

( * ) Notice: Subject to any disclaimer, the term of this patent is extended or adjusted under 35 U.S.C. 154(b) by 468 days.

(21) Appl. No.: 12/373,610

(22) PCT Filed: Aug. 24, 2006

(86) PCT No.: PCT/AU2006/001227

§ 371 (c)(1),
(2), (4) Date: Sep. 16, 2009

(87) PCT Pub. No.: WO2008/006133

PCT Pub. Date: Jan. 17, 2008

(65) Prior Publication Data

US 2010/0050339 A1 Mar. 4, 2010

(30) Foreign Application Priority Data

Jul. 14, 2006 (AU) ..... 2006203023

(51) Int. Cl.
*A47C 31/00* (2006.01)

(52) U.S. Cl. ..... 5/411; 5/691

(58) Field of Classification Search ..... 6/411, 658, 6/496, 691; 5/411, 658, 496, 691, 659, 618
See application file for complete search history.

(56) References Cited

U.S. PATENT DOCUMENTS

| | | | | |
|---|---|---|---|---|
| 4,336,621 | A * | 6/1982 | Schwartz et al. | 5/658 |
| 5,491,854 | A | 2/1996 | Music | 5/618 |
| 5,737,783 | A | 4/1998 | Antinori | 5/411 |
| 6,012,186 | A | 1/2000 | Soltani et al. | 5/614 |
| 6,502,255 | B1 | 1/2003 | Perkins et al. | |
| 6,889,396 | B2 | 5/2005 | Weinman | |
| 2002/0174487 | A1 | 11/2002 | Kramer et al. | 5/618 |

OTHER PUBLICATIONS

GB0900545.5 Examination Report dated Jul. 27, 2010.

* cited by examiner

*Primary Examiner* — Fredrick Conley
(74) *Attorney, Agent, or Firm* — Woodard Emhardt Moriarty McNett & Henry LLP

(57) ABSTRACT

A mattress buckle for securing the position of a mattress (22) on the base (16) of an adjustable bed (10). The mattress comprises one of a pair of male and female elements of the buckle (12) secured to an upper surface of the bed base (16) and the other of the pair of male and female elements of the buckle (12) secured to the underside of the mattress (22). When these elements of the buckle are interlocked in snap-fit engagement, the mattress is constrained against movement on the base as the adjustable panels of the bed base are articulated relative to one another through various positions of adjustment.

8 Claims, 4 Drawing Sheets

MATTRESS RETAINER BUCKLE

FIELD OF THE INVENTION

The present invention pertains generally to bedding systems, and more particularly, to a retainer for maintaining the position of a mattress on an adjustable bed.

BACKGROUND OF THE INVENTION

Adjustable beds are known in the art and provide improved comfort to persons resting thereon by permitting various portions of the sleeping surface to be selectively adjusted to different positions. Generally, these adjustable beds comprise a mattress supported on a bed frame having an adjustable mattress support. The mattress support includes one or more adjustable panels, and typically, between about three and five adjustable panels. The adjustable panels are movable from a horizontal position to permit various portions of the mattress to be raised and/or lowered to thereby provide a comfortable position for persons reclining thereon. The adjustable panels may be moved by manual manipulation of individual panels, by hand cranks, or more typically, by linkages actuated by motors provided in a base of the bed frame.

When adjustable beds are operated to raise and/or lower various portions of the mattress, the mattress has a tendency to shift longitudinally on the support unless it is constrained. In the past, mattresses used on adjustable beds have most commonly been constrained by a mattress retainer in the form of a plate or rail disposed at the foot of the bed frame and extending upwardly along side the foot of the mattress. Besides detracting from the aesthetic appearance of the bed, this type of mattress retainer also creates a barrier at the foot of the bed which may be uncomfortable to persons who are sitting on the edge of the mattress. Furthermore, there is a problem with this type of mattress retainer when used on a retail store display. When so used and displayed and while demonstrating the adjustable bed to a potential consumer, if both the head and foot ends of the bed are raised, the mattress lifts up in the air off of the center section of the bed, thereby presenting an unsightly and unprofessional product.

Another form of mattress retainer is disclosed in U.S. Pat. No. 7,047,579. According to the disclosure of this patent, a clip is secured to the edge of the adjustable bed base and is engageable with a raised edge border of the mattress so as to clamp the tapered edge of the mattress to the bed base. But this type of retainer is subject to tearing of the edge of the mattress if a person resting or seated atop the mattress applies exclusive force, causing movement of the mattress on the adjustable bed base.

Another form of mattress retainer is disclosed in U.S. Pat. No. 6,889,396. According to the disclosure of this patent, two opposed clips on opposite sides of an adjustable bed base are insertable into sleeves attached to the underside of a mattress so as to secure the mattress against movement on the adjustable bed base. This type of retainer is physically difficult to use or apply because it is necessary to bend the mattress so that the edges of the sleeve or sleeves on the underside of the mattress fit into the clips on the bed base. Furthermore, this type of retainer may also be subject to tearing of the underside of the mattress if excessive force is applied to move the mattress on the bed base.

A need therefore exists for an improved mattress retainer for use with adjustable beds which overcome these and other drawbacks of the prior art mattress retainers.

SUMMARY OF THE INVENTION

The present invention provides a mattress retainer suited for use with adjustable beds to constrain movement of a mattress relative to an adjustable mattress support when the mattress support is articulated to reposition various portions of the mattress. The mattress retainer is a two-piece snap-fit buckle, one piece of which is secured to the upper surface of the mattress supporting adjustable bed base and the other piece of which is secured to the underside of the mattress, such that the two-piece buckle is positioned between the mattress and the mattress support. When the buckle is closed or clamped shut, the mattress cannot shift on the mattress support as the adjustable mattress support or base is articulated to raise and/or lower various portions of the mattress. Because the buckle is relatively flat and positioned beneath the mattress, the buckle does not interfere with the comfort of persons sitting near the edge of the mattress or lying atop the mattress.

In a preferred embodiment, the mattress retainer comprises a pair of identical spaced snap-fit buckles having a generally flat profile located on opposite sides of the mattress near the outer side edges of the mattress and the bed base. By so locating the buckles near the sides of the mattress, the buckles are easily manipulated beneath the mattress for purposes of physically opening or closing them.

Preferably, the two pieces of the buckles are secured to a fabric strap, which strap is attached to the underside of the mattress and the top side of the bed base with the straps and buckles being so positioned that the mattress may be reversed end-for-end so as to accommodate extended life and use of the mattress.

The advantages and objectives of the present invention will become more readily apparent from the following detailed description taken in conjunction with the accompanying drawings.

DETAILED DESCRIPTION

Figure 1:
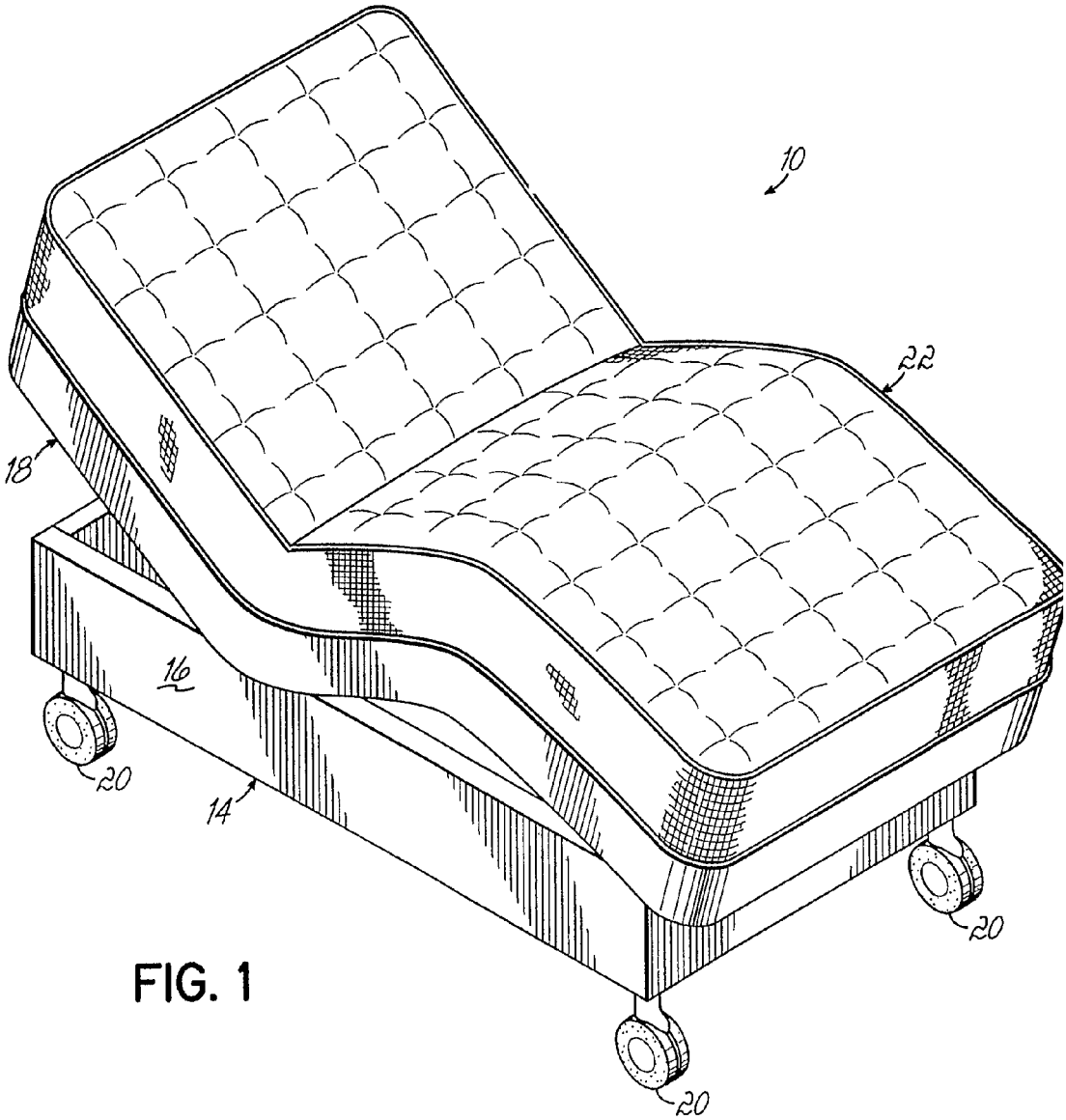
FIG. 1 is a perspective view of an adjustable bed of the type to which the invention of this application is applicable.
Figure 2:
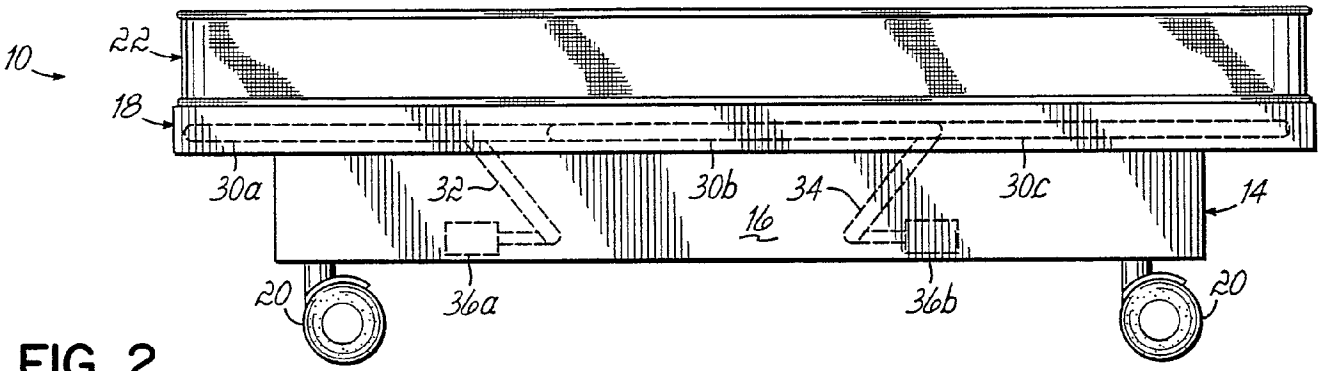
FIG. 2 is a side elevational view of the adjustable bed of FIG. 1.
Figure 3:
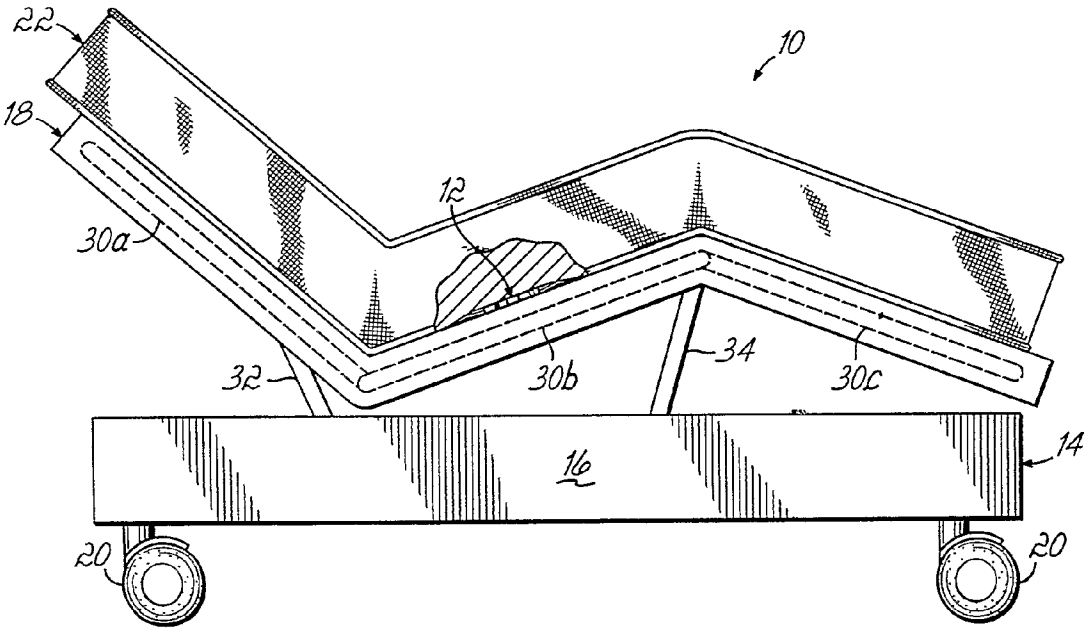
FIG. 3 is a side elevation of the adjustable bed of FIG. 2, depicting the mattress in an adjusted configuration.

Referring to FIGS. 1, 2 and 3, there is shown a typical adjustable bed 10 of the type with which the mattress buckle retainers 12 (FIGS. 3, 4, 5 and 6) according to this invention may be utilized. The adjustable bed 10 comprises a bed frame 14 including a base 16 and an adjustable mattress support 18 disposed on an upper portion of the base 16. Casters 20 may be provided on the base 16 to facilitate repositioning the adjustable bed 10 within a room. A conventional adjustable mattress 22 is disposed on the mattress support 18.

Figure 4:
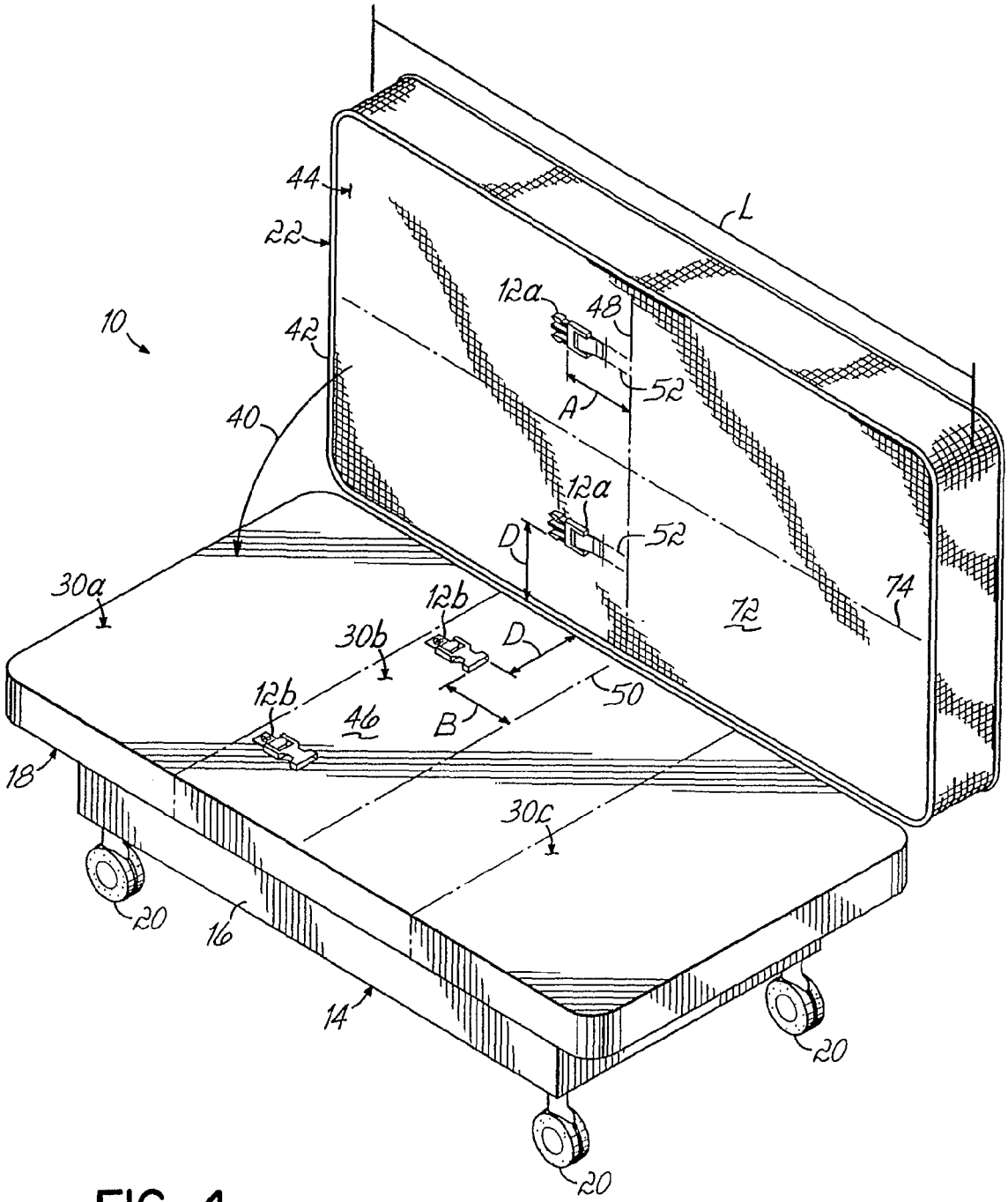
FIG. 4 is a perspective view of the adjustable bed of FIG. 1, with the mattress tilted upwardly for purposes of illustrating the mattress retainers and the location of the retainers on the underside of the mattress and top side of the bed base.

With particular reference to FIG. 4, it will be seen that a pair of mattress retainer buckles 12 are disposed on opposite longitudinal sides of the mattress support 18 and the mattress 22 such that the mattress retainers 12 reside between the mattress support 18 and the mattress 22 when the mattress is atop the support. The mattress retainer buckles 12 each comprise a snap-fit male section or component 12*a* attached to the underside of the mattress and a female section or component 12*b* attached to the top side of the mattress support 18. Advantageously, when various portions of the mattress are raised and/or lowered to desired positions, the retainer buckles 12 constrain the position of the mattress 22 on the mattress support 18.

In the exemplary embodiment shown in FIGS. 1, 2 and 3, mattress support 18 of adjustable bed 10 includes several adjustable panels 30*a*, 30*b*, 30*c* (collectively identified herein with reference numeral 30) which are movable to various desired positions by linkages 32, 34 actuated by motors 36*a*, 36*b* provided in base 16. While the retainer buckles 12 are depicted as being positioned along opposite longitudinal sides of the mattress support 18 and mattress 22 and midway of the length of the mattress, it will be recognized that the mattress retainer buckles 12 may alternatively be positioned at various other locations on the mattress support 18 to engage other portions of mattress 22. The positions depicted for the buckles on opposite sides of the mattress and near midway of the length of the mattress facilitate ease of manipulation of the buckles for purposes of opening and closing them and also, as explained more fully hereinafter, enable the mattress to be reversed end-for-end on the mattress support if wear, stains, etc., ever make such end-for-end reversal desirable.

With reference now to FIG. 4, there is illustrated the adjustable bed 10, but with the mattress 22 tilted upwardly as indicated by the arrow 40 about the rear edge 42 of the mattress so as to illustrate the relative positioning of the male sections 12*a* of the buckles 12 on the underside 44 of the mattress and the female sections 12*b* of the buckles on the top surface 46 of the adjustable mattress support panel 30*b*. It will be noted that there are two male elements of the buckles 12 located adjacent the sides of the mattress and adjacent but spaced slightly by a distance A from a transverse center line 48 located medially of the length L of the mattress. Similarly, there are a pair of female buckle elements 12*b* located adjacent the sides of the mattress and adjacent but spaced a distance B from the transverse center line 50 of the support surface of the support panels 30 of the bed base. The distance A is equal to the distance B and the buckle elements are spaced the same distance D from the sides of the bed base so that when the mattress is placed atop the supporting surface of the bed base, the male elements 12*a* of the buckles will line up with the female elements 12*b*, such that the two may be snap-fit together so as to secure the mattress against movement on the supporting surface of the bed base.

Figure 5:
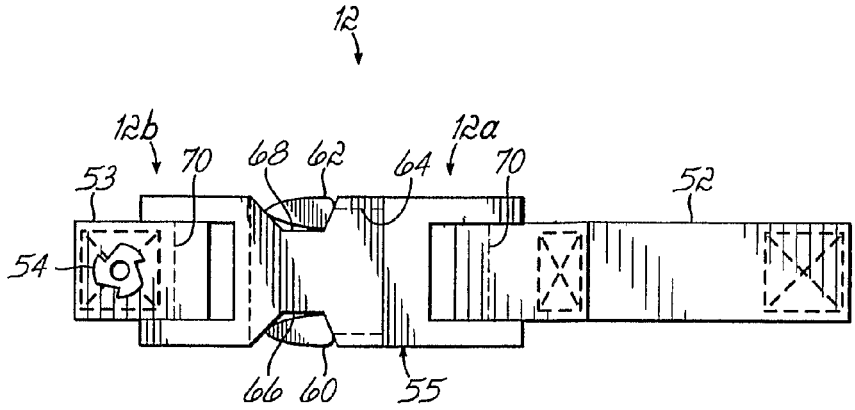
FIG. 5 is a perspective view of a buckle retainer in a closed position.
Figure 6:
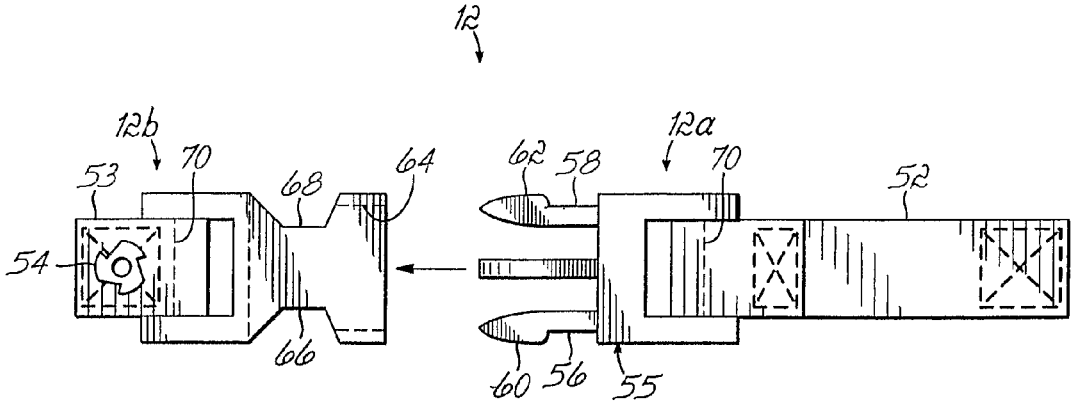
FIG. 6 is a plan view of the buckle retainer in an open position.

Referring now particularly to FIGS. 5 and 6, there is illustrated a conventional snap-fit buckle of the type utilized in the practice of this invention. The two parts or two elements of the buckle 12 include the male buckle element 12*a* that can be received and releasably locked in the female buckle element 12*b*. Buckle 12 may be made of a variety of materials with numerous plastics particularly being suitable.

The male buckle element 12*a* is attached to the underside of the mattress by a flexible fabric strap 52 which is sewn or otherwise fixedly attached to the underside of the mattress. The female buckle element 12*b* is anchored to the top surface of the mattress supporting panel 30*b* by a flexible fabric strap 53 which is, in turn, secured to the panel 30*b* by a bolt which extends upwardly (bolt not shown) from the underside of the support panel 30*b* into a T-nut 54 located atop the female buckle strap 53. It should be understood that fabric straps or other devices may be utilized to anchor both the female and male elements of the buckle 12 to the underside of the mattress and the top side of the mattress supporting panel 30*b*.

The manner in which the male buckle part 12*a* is releasably received in and connected to female buckle part 12*b* is known to those skilled in the art and may take numerous configurations. In the exemplary embodiment shown, a connecting structure 55 of the male buckle part has forwardly projecting arms 56, 58 with enlargements or lateral projections 60, 62. Female buckle element 12*b* defines therein a hollow chamber or pocket 64 having lateral windows 66, 68. Windows 66, 68 are sized and arranged to receive therein the projections 60, 62 of arms 56, 58, respectively. Arms 56, 58 deflect inwardly as male buckle part 12*a* is inserted into female buckle part 12*b* and spring outwardly to expose projections 60, 62 through windows 66, 68 of female buckle element 12*b*, as male buckle element 12*a* is fully inserted. Male buckle element 12*a* is released from female buckle element 12*b* by pushing inwardly on projections 60, 62 while urging male buckle element 12*a* and female buckle element 12*b* in opposite directions.

The tag ends of the straps 52, 53 of the male and female buckle elements extend around cross bars 70 of the connecting portion of the male and female buckle elements and are sewn or otherwise secured to the major portion of the straps so as to secure the buckle elements to the straps, again as is conventional for securing flexible fabric straps to snap-fit buckles of the type here illustrated.

With reference to FIG. 4, it will be seen that the strap 52 attached to the male buckle element 12*a* extends beneath a fabric covering material 72 on the underside of the mattress, but has a free end section adjacent the buckle element 12*a* located on the top sides of the covering 72. This fabric covering material 72 may be either woven or unwoven fabric material. But in any event, the end of the strap 52 resides beneath or on the underside of the covering material 72 and, as described hereinabove, is sewn or otherwise secured to the mattress covering materials.

While there are two buckles 12 utilized in the preferred embodiment of this invention, it is possible to secure the mattress 22 against movement on the adjustable base by means of only a single buckle (not shown). In that event, the buckle 12 would preferably be located near the transverse center line 48 of the mattress and bed base, and the longitudinal center line 74. By utilizing two buckles 12 as illustrated in FIG. 4 and positioning them adjacent the opposite sides of the mattress and bed base, the mattress is secured against both rotational and longitudinal movement relative to the base.

In the course of attaching the mattress to the bed base, the mattress 22 having the male buckle elements 12*a* attached thereto is placed on top of the base and then a person, by slipping their hand underneath the mattress, is able to insert the male element of the buckle 12 into the female element 12*b* so as to secure the mattress to the base and prevent any movement relative thereto. If for any reason the user of the adjustable bed 10 desires to flip the mattress from one end to the other, either because of stains, wear, etc., all that is required is to release the buckles by pressing the protrusions 60, 62 of the buckles inwardly while pulling the elements of the buckle in opposite directions to release the buckles. Then, what had been the head end of the mattress may be placed at the foot end of the bed base, and the male elements 12*a* of the buckles may then be flipped 180° from one side of the center line 48 to the other so as to realign the arms 56, 58 of the buckle element 12*a* with the openings in the female element of the buckles and the buckles snap-fit together to secure the end-to-end reversed mattress to the base.

While we have described only a single preferred embodiment of our invention, persons skilled in this art will appreciate changes and modifications which may be made without departing from the spirit of our invention.

The invention claimed is:

1. An adjustable bed, comprising:

a bed base having a plurality of support panels defining a mattress support surface, at least one of said support panels being movable relative to at least one other of said support panels to thereby adjust the bed;

a mattress located atop said support surface; and a snap-fit buckle for securing said mattress atop said support surface wherein said snap-fit buckle comprising a male element and a female element, one of said male element and said female element being secured to the top of one of said support panels, and the other of said male element and said female element being secured to an underside surface of the mattress such that engagement of said male element and said female element of said snap-fit buckle fixes the position of said mattress on said one of said support panels, wherein said snap-fit buckle extends in a generally lengthwise direction of said adjustable bed.

2. The adjustable bed of claim 1 wherein said one of said male element and female element is secured to the top of said one of said support panels by a flexible strap.

3. The adjustable bed of claim 2 wherein said flexible strap is secured to the top of one of said support panels by a nut and bolt connection.

4. The adjustable bed of claim 1 wherein the other of said male element and female element is secured to the underside of the mattress by a flexible strap.

5. The adjustable bed of claim 4 wherein at least a portion of said flexible strap is secured to the underside of the mattress beneath a fabric covering on the underside of said mattress.

6. The adjustable bed of claim 1 wherein said snap-fit buckle is located near the midpoint in the length of said mattress such that said mattress may be reversed end-for-end and secured by said snap-fit buckle on said support surface of said bed base.

7. The adjustable bed of claim 1 which further comprises two said snap-fit buckles, extending along and adjacent opposing longitudinal edges of said adjustable bed.

8. A method of securing a mattress to the support surface of an adjustable bed base, the method comprising the following steps:

securing one of a male element and a female element of a snap-fit buckle to the support surface of the adjustable bed base;

securing the other of the male element and the female element of the snap-fit buckled to the underside of a mattress;

positioning the underside of the mattress on the top of the support surface of the adjustable bed base; and engaging the male element and the female element of the snap-fit buckle to secure the mattress in a fixed position atop the support surface of the adjustable bed base, wherein said snap-fit buckle extends in a generally lengthwise direction of said adjustable bed.

* * * * *